US005279240A

United States Patent [19]

Worley

[11] Patent Number: 5,279,240

[45] Date of Patent: Jan. 18, 1994

[54] FLOATING OIL/GAS PRODUCTION TERMINAL

[76] Inventor: Marvin S. Worley, 24 South View Court, Hill View Road, Woking, Surrey GU22 7RP, United Kingdom

[21] Appl. No.: 744,574

[22] Filed: Aug. 14, 1991

[30] Foreign Application Priority Data

Aug. 14, 1990 [GB] United Kingdom ..... 9017739

[51] Int. Cl.[5] ..... B63B 25/08

[52] U.S. Cl. ..... 114/74 T; 441/5

[58] Field of Search ..... 114/264, 265, 230, 61, 114/745, 256; 441/1-5

[56] References Cited

U.S. PATENT DOCUMENTS

| | | | |
|---|---|---|---|
| 1,285,182 | 11/1918 | Hoffman | 114/61 |
| 1,757,174 | 5/1930 | Douglas | 114/61 |
| 3,271,964 | 9/1966 | Wolff | 114/265 |
| 3,490,406 | 1/1970 | O'Reilly et al. | 114/265 |
| 3,590,407 | 7/1971 | Bratianu et al. | 114/265 |
| 3,610,193 | 10/1971 | Lacy et al. | 114/265 |
| 3,664,286 | 5/1972 | Chaney | 114/265 |
| 3,673,974 | 7/1972 | Harper | 114/265 |
| 3,830,176 | 8/1974 | Arita et al. | 114/265 |
| 3,894,503 | 7/1975 | McClure | 114/65 R |
| 4,033,277 | 7/1977 | Schaper | 114/230 |
| 4,216,559 | 8/1980 | Switlik, Jr. . | |
| 4,753,185 | 6/1988 | Salusbury-Hughes | 114/61 |

FOREIGN PATENT DOCUMENTS

| | | |
|---|---|---|
| 1490068 | 10/1977 | United Kingdom . |
| 1554284 | 10/1979 | United Kingdom . |

OTHER PUBLICATIONS

Search Report, May 6, 1984, United Kingdom.

Article—*Structural Integrity and Design of Tandem Hull Floating Production Platform*, D. T. Brown, et al. Offshore Technology Conference (OTC 6277), May, 1990.

Article—*On the Hydrodynamics of Tandem-Hull Marine Vehicles*, M. H. Patel, Journal of Ship Research, vol. 30. No. 4, Dec., 1986, pp. 275-286.

*Primary Examiner*—Jesus D. Sotelo

*Attorney, Agent, or Firm*—Kinney & Lange

[57] ABSTRACT

The disclosure relates to a floating oil/gas production terminal comprising a multi-hull vessel having a plurality of vertically spaced barge form hulls interconnected together to form a unitary structure including an upper hull which floats the vessel and a lower hull which provides gas/oil/other liquid storage space. A vertical throughway extends through the hulls towards one end thereof and a manifold system is disposed in the free space between the hulls and is mounted for rotation on the upper and/or lower hulls about a vertical axis extending through the throughway to receive a plurality of pipelines connected directly or indirectly to seabed wellheads. A rotary fluid coupling is provided having two elements relatively rotatable about the vertical axis. One element has a connection to conduit a mounted on the upper hull and a second element is connected by a conduit to the manifold system between the hulls whereby the vessel may swing about the vertical axis leaving the manifold system and pipe line(s) connected thereto stationary with respect to the seabed.

13 Claims, 6 Drawing Sheets

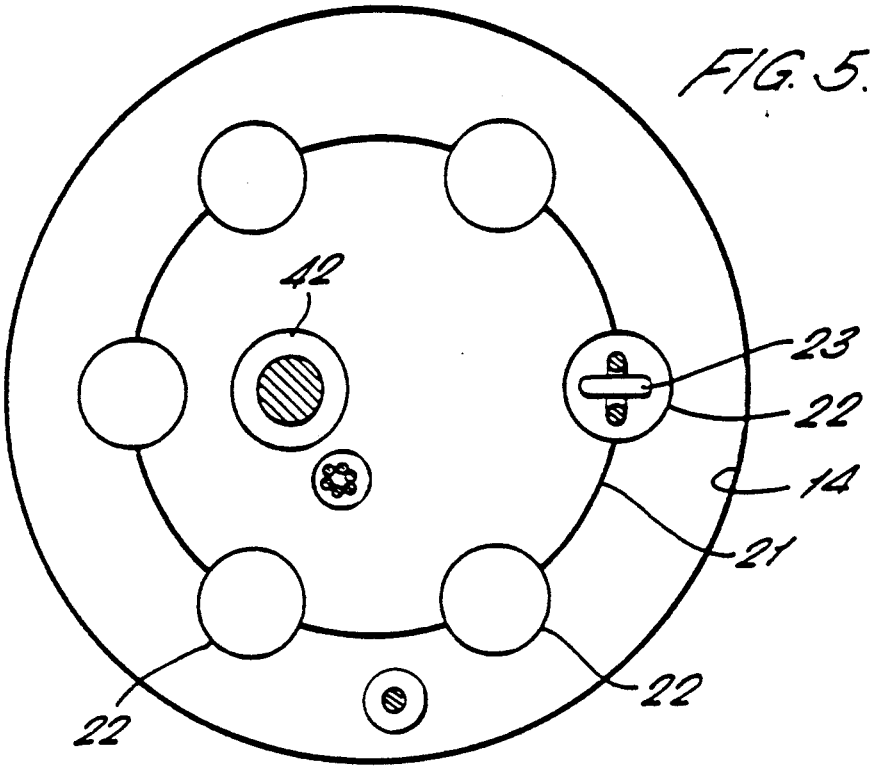
FIG. 5.
FIG. 6.
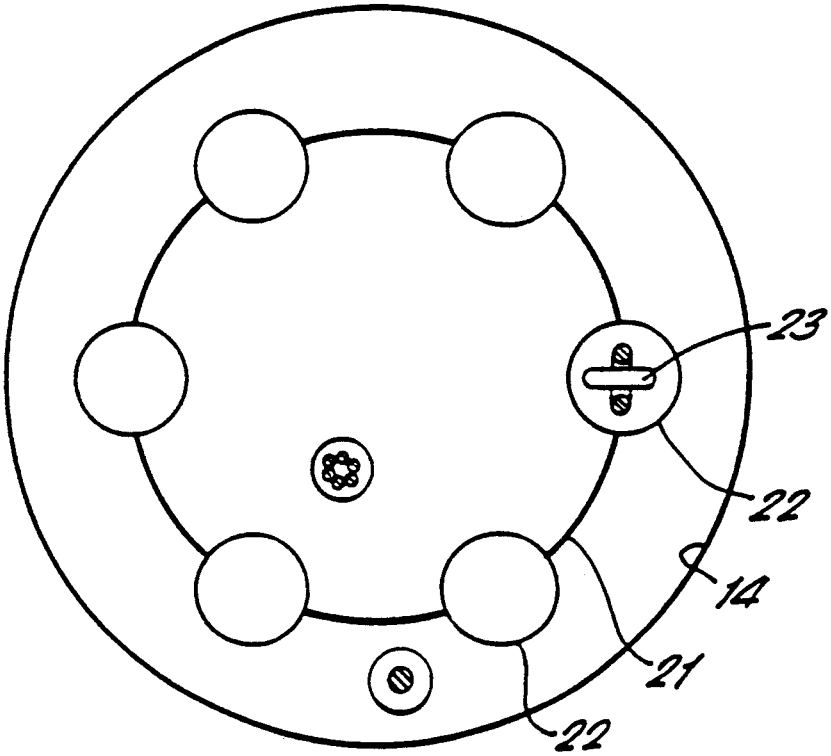

FLOATING OIL/GAS PRODUCTION TERMINAL

DESCRIPTION OF THE INVENTION

1. Field of the Invention

This invention relates to a floating oil/gas production terminal.

2. Background Prior Art

Offshore oil and gas fields are conventionally provided with wells drilled through the seabed. Wellheads are installed above sea level on fixed platforms. When floating production vessels are used the wallheads are installed on the seabed and connected by flexible or rigid pipeline risers to the floating platforms. The floating production vessels may be monohulls, multihulls including vessels of the type described in U.S. Pat. No. 4,753,185 or semi-submersible hulls. All three basic types may be moored in a fixed position with anchor lines from the corners and sides of the vessels. When severe weather can be encountered, monohulls and multi-hulls may be turret moored, to allow the bow of the vessel to always point toward the prevailing major component of waves, winds and currents resulting in much improved seakeeping.

Turret mooring usually requires a product distribution swivel-coupling for each continuous pipeline, control line or electric line extending between the vessel and the seabed to allow continuity of fluid stream, control signal/power and electric current. Similar swivel/-couplings are required for pipelines to allow injection of water or gas from the vessel into one or more wells in the oil reservoir or to allow processed oil and gas to be returned to the seabed for transport to pipeline or oil to a nearby moored tanker.

The swivels/couplings must often be designed for vary high pressures and temperatures. They are expensive, heavy and require elaborate and concentrated handling facilities on the weather vaning turret of the vessel. Subsea manifolds are usually necessary to minimise the number of high cost swivel/couplings that are required at the interface between the rotating, weather vaning vessel and the stationary pipelines on the seabed. Typically one or more manifolds may be required for each of the following: well stream flow, well test, water injection, gas injection, and drilling mud injection for well kill. A considerable space is required to accomodate such manifolds.

A significant amount of maintenance, adjustment, repair and replacement is invariably required for such arrangements. Lost oil and gas production also occurs while awaiting the arrival of complex and expensive deep sea diving equipment and for tedious repairs hundreds of feet below sea level.

To provide for the necessary space and laydown area when using a traditional monohull vessel with turret mooring and with manifold and maintenance/laydown space between the product swivels and the seabed, a very large moonpool would be required. The large moonpool would substantially weaken the vessel hull structure requiring excessive reinforcements resulting in high costs.

SUMMARY OF THE INVENTION

This invention provides a floating oil/gas production terminal comprising a multi-hull vessel having a plurality of vertically spaced barge form hulls interconnected together to form a unitary structure including an upper hull which floats the vessel and a lower hull which provides gas/oil/other liquid storage space, a vertical throughway extending through the hulls towards one end thereof, manifold means disposed between the hulls and mounted for rotation on either or both upper and lower hulls about a vertical axis extending through the throughway to receive a plurality of pipelines connected directly or indirectly to seabed wellheads, and a rotary fluid coupling having two elements relatively rotatable about said vertical axis, one element having means for connection to conduit means mounted on the upper hull and a second element connected by conduit to the manifold means located in the free space between the hulls whereby the vessel may swing about said vertical axis leaving said manifold means and pipe line(s) connected thereto stationary with respect to the seabed.

Thus, in accordance with the invention the very high costs which otherwise occur can be greatly reduced by placing the manifolds in an accessible location between the spaced hulls of the vessel, within air diving range and where there is ample space for all the manifolds that may eventually be required and also for footing and equipment laydown for those engaged in maintenance of the manifolds allowing the manifolds to be quickly and efficiently maintained without the need for costly deep sea diving facilities and specialist personnel.

In a preferred arrangement the manifold means may comprise an annular manifold mounted with its axis coincident with the throughway axis to rotate with the hulls about said vertical axis, the manifold having a plurality of connections to receive fluid pipelines from a wellhead or wellheads and having a conduit connection to said rotary fluid.

More specifically said manifold means may comprise a plurality of annular manifolds mounted for rotation about the vertical axis on the upper and/or lower hulls to which separate sets of pipelines may be connected, and a corresponding plurality of said rotary fluid couplings may be provided to which the manifolds are respectively connected.

In any of the above arrangments a turret may extend through at least part of the throughway, the turret being mounted for rotation about said vertical axis on one or both of said hulls and said manifold means and said second element of the rotary fluid coupling may be mounted on the turret.

In one arrangement according to the invention turret may be mounted on the upper hull of the vessel and extends downwardly through the upper hull and the manifold means may be suspended from the turret between the hulls of the vessel.

In another arrangement according to the invention the turret may be mounted on the lower hull and may project upwardly therefrom through the upper hull to support said second element of the rotary fluid coupling mounted above the upper hull.

In a still further arrangement the turret may extend through both upper and lower hulls and may be mounted on both hulls carrying said second element of the rotary fluid coupling above the upper hull and the manifold means between the hulls.

More specifically the turret may have an annular table at its upper and extending over the upper hull around the upper end of the throughway therein and supported on the upper hull on bearing means to support the turret in the vertical direction and further bearing means being provided between the turret and throughway to support the turret horizontally.

In the case where the turret is supported in both upper and lower hulls, further bearing means may be provided between the turret and the throughway in the upper and lower hulls to assist in supporting the turret horizontally.

In the case where the turret is mounted on the lower hull the turret may have a turntable overlying the lower hull around the throughway therein and bearing means may be provided between the turntable and deck of the lower hull to support the turret vertically and further bearing means are provided between the turret and the throughway in the lower hull to support the turret horizontally.

Anchor means for anchoring the vessel to the seabed may also be connected to said turret whereby the vessel may swing about said vertical axis with the manifold means and pipelines connected thereto remaining stationary with respect to the seabed. For example the anchorage means may comprise chain stopper means mounted on the turret to receive one or more anchor chains from the seabed.

In the case where the lower end of the turret extends through the lower hull of the vessel, hawser pipes may be mounted in the lower end of the turret to receive chains from the seabed and said chain stopper means are provided on the turntable of the turret to receive the ends of the anchor chains.

BRIEF DESCRIPTION OF THE DRAWINGS

FIG. 5 is a section on the line 5-5 of FIG. 4;

FIG. 6 is a section on the line 6-6 of FIG. 4;

DESCRIPTION OF THE PREFERRED EMBODIMENTS

Figure 1:
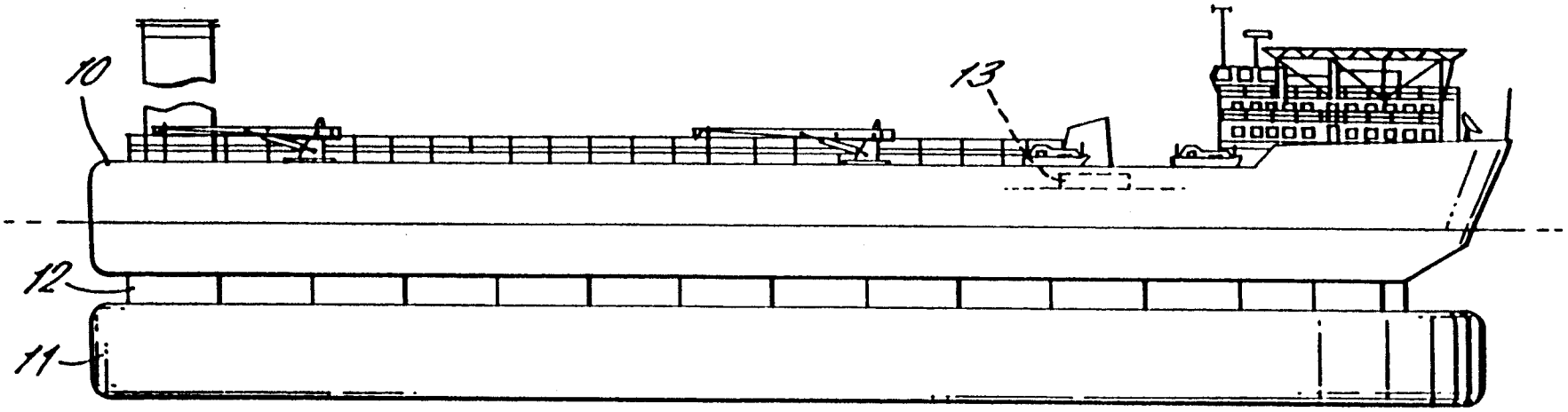
FIG. 1 is a side elevation view of a twin hulled floating oil/gas production vessel embodying a rotary turret having turntables mounted on the upper and lower holes of the vessel to receive anchor chains oil/gas production pipelines and control lines.
Figure 2:
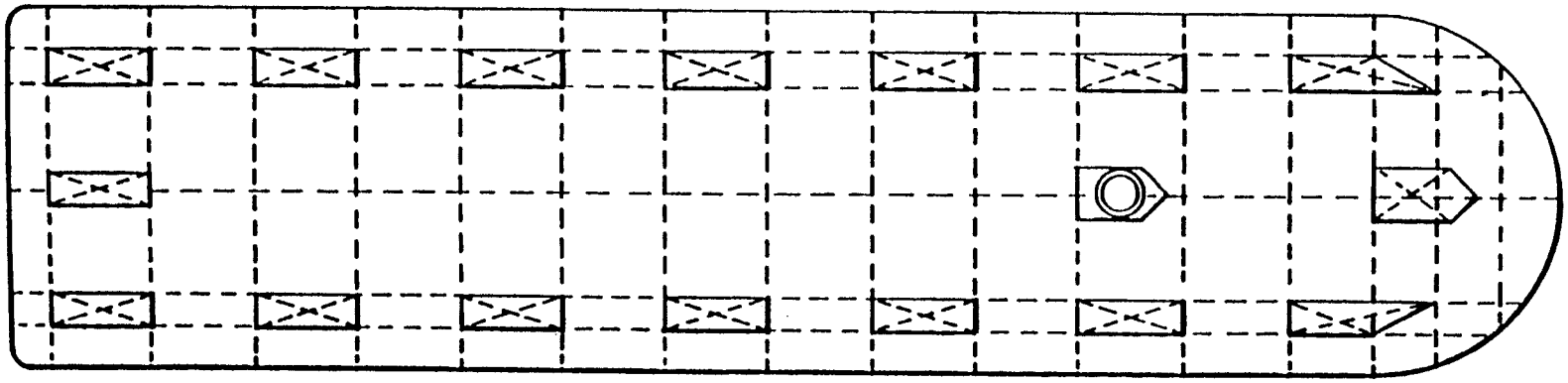
FIG. 2 is a diagrammatic sectional view through part of the vessel in which the turret is mounted.
Figure 3:
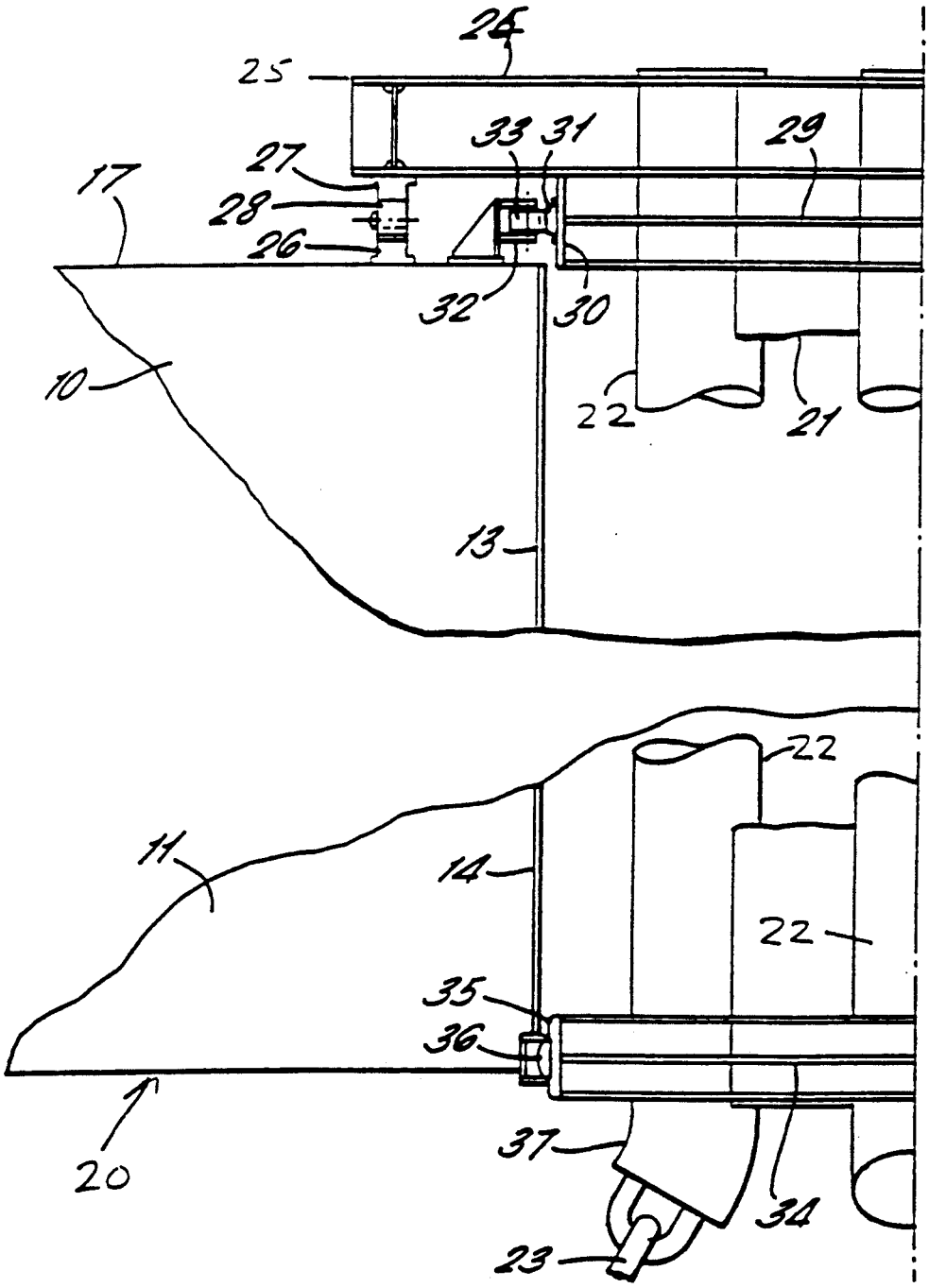
FIG. 3 is a detailed view of an upper part of the turret including the upper turntable mounted on the deck of the upper hull of the vessel.
Figure 4:
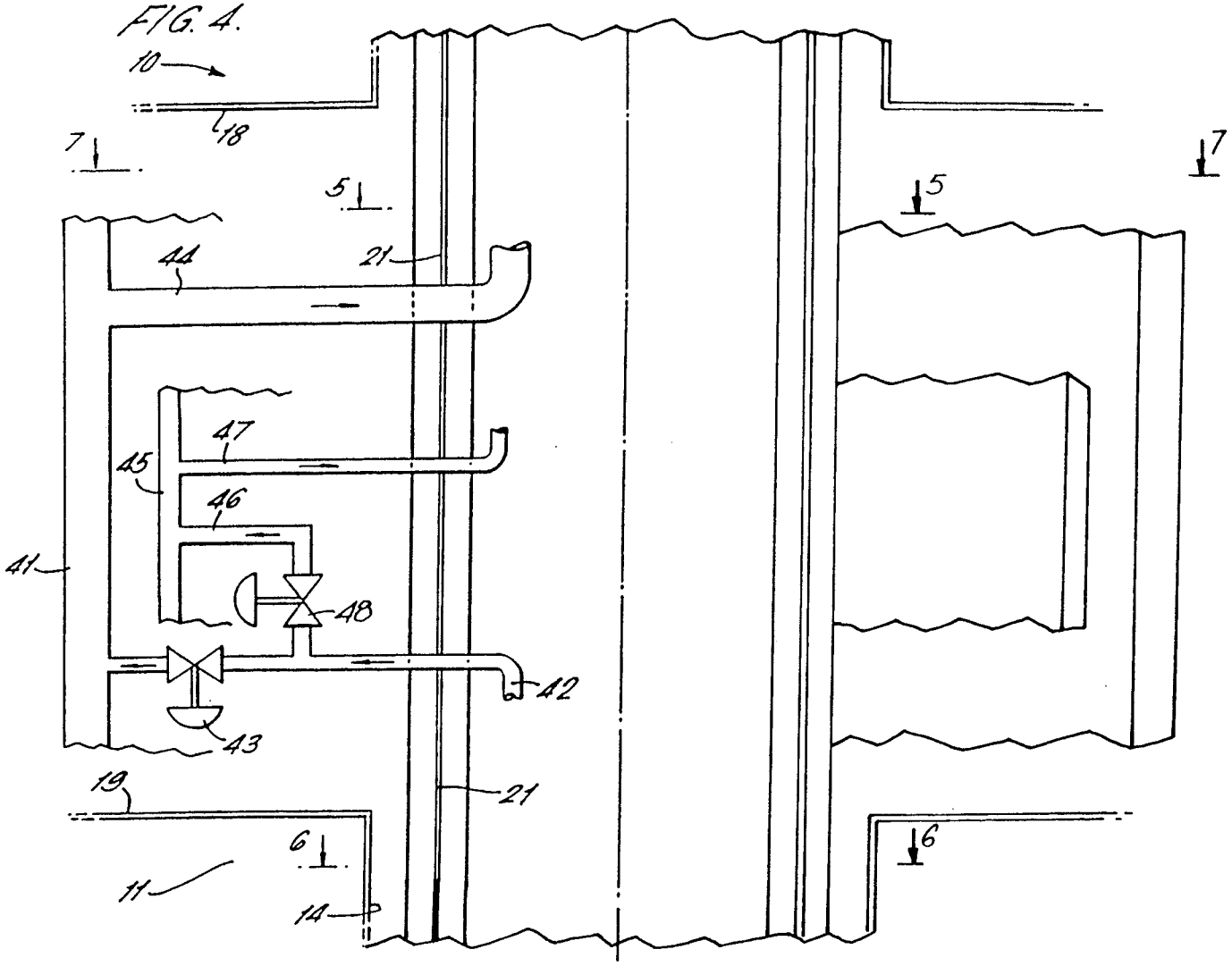
FIG. 4 is a section of the turret arrangement between the upper and lower hulls illustrating a system of manifolds to which pipelines from the well below are connected.

Referring firstly to FIG. 1 of the drawings, there is shown a twin hulled vessel of the type described and illustrated in U.S. Pat. No. 4,753,185 comprising upper and lower "barge" form hulls 10, 11 secured together by rows of spaced short struts 12. The upper of the hulls provides floatation for the vessel and has oil/gas production facilities and delivery facilities for delivering to oil or liquid gas tankers moored at a safe distance. The upper hull also has accommodation units for the staff stationed on the vessel. The lower hull has storage tanks in which oil/gas liquids are stored prior to delivery to a tanker.

Towards one end of the vessel both upper and lower hulls have aligned vertical throughways or "moonpools" 13, 14 respectively extending through the hulls. A rotary turret for receiving both mooring chains and pipelines to and from the various oil/gas fields serviced by the vessel is mounted in the respective throughways as will now be described in detail with respect to FIGS. 3 to 7.

Referring to FIGS. 3 to 7, throughway 13 extends through the hull 10 from the deck 17 of the upper hull to the bottom 18 of the upper hull and throughway 14 extends from the deck 19 of the lower hull to the bottom 20 of the lower hull. A rotary turret is mounted on the hulls of the vessel extending through the throughways 13, 14 to receive both chain hawsers for anchoring the vessel and water/gas/mud injection gas/oil production pipelines as will be described below. The turret comprises a vertically extending tubular column 21 the wall of which embodies six (or more) aquispaced vertically extending hard pipes 22 to receive chain hawsers 23 extending from spaced seabed anchors. The column 21 is supported by a number of vertically spaced "spider" form support structures which are not shown.

The upper end of the column projects above deck 17 of the upper hull and is secured to a rotary table 24 the periphery 25 of which overlies the deck 17. The upper side of the deck and the underside of the outer peripheral part of the table have annular rails 26, 27 mounted thereon between which thrust rollers 28 are disposed to support the turret in the vertical direction for rotation with respect to the vessel hulls.

The table 24 has a smaller diameter undertable 29 having an outer periphery 30 slightly less in diameter than the throughway 13 and on which an annular track 31 is mounted. An annular bracket 32 is mounted on the deck 17 around the upper end of the throughway 13 on which a multiplicity of radial load rollers 33 are mounted to engage the track 31 and support the upper end of the turret radially in the throughway. The lower end of the turret column 21 terminates in a bottom plate 34 having a peripheral wall 35 and a self lubricating bearing 36 (e.g. of aluminium bronze) is disposed between the peripheral wall 35 and bottom periphery of the throughway 14 in the lower hull to locate the lower end of the turret laterally. A split bearing design could be used to enable removal and replacement on site. In a further construction the turret may have a plain bearing plate supported for rotation or a lubricated fixed plate mounted on the deck.

As indicated earlier, the turret includes six hard pipes 22 through which the chain hawsers extend. The pipes 22 have lower ends 37 extending below the bottom plate 34 of the turret which are turned outwardly to provide an angled lead to the turret for the mooring chains 23 extending from the seabed at locations spaced around a wide pitch circle. The pipes 22 extend through the under and upper turntables 29, 24 on the upper hull of the vessel and the chains are led through the upper ends of the pipes to conventional chain stoppers 38 or other anchorages mounted on the upper side of the turntable which are not shown. Thus the rotary turret is anchored to the seabed and the vessel on which the turret is mounted is allowed to "weather vane" in accordance with the prevailing wind/sea conditions around the turret.

Figure 7:
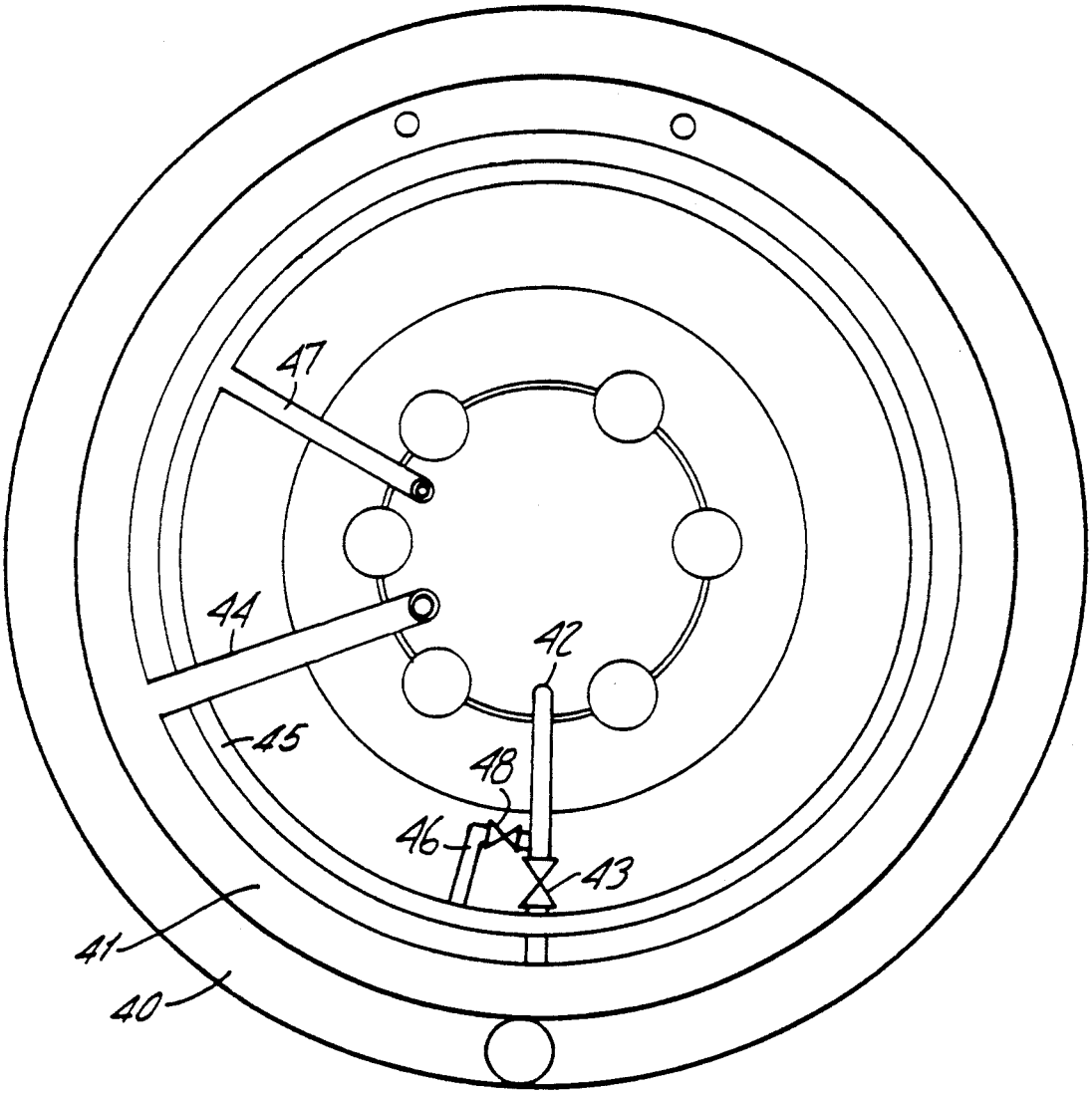
FIG. 7 is a plan view of the lower turntable of the turret of FIG. 4 as viewed as if looking between the hulls with the lower hull omitted.

A further rotary turntable 40 similar to table 24 is mounted on the deck 19 of the lower hull and with the outer peripheral part of the table being indicated on FIG. 7. An annular manifold 41 is mounted on the turntable 40 to receive oil or gas from the wellhead and, to that end, a number of risers one of which is indicated at 42 on FIG. 5 extend from the seabed through the lower end of the turret column and thence out through the turret wall 21 and via a control valve 43 to the manifold 41. A single delivery conduit 44 extends from the upper end of the manifold radially inwardly through the wall 21 of the turret and thence upwardly to a multiple rotary coupling unit mounted on the turntable 24 to be described later. A further annular manifold 45 for individual well testing purposes is also mounted on table 40 with connections 46 via valves 48 to each riser 42 and a single outlet conduit 47 extending through the turret to the rotary coupling unit on the table above. Further manifolds are provided on the rotary table 40 on the lower hull as required for gas and/or water injection into the field as and when required. A bundle of hydraulic/electrical control lines from the various control valves and ancilliary equipment extends up through the turret as indicated at 49.

Figure 8:
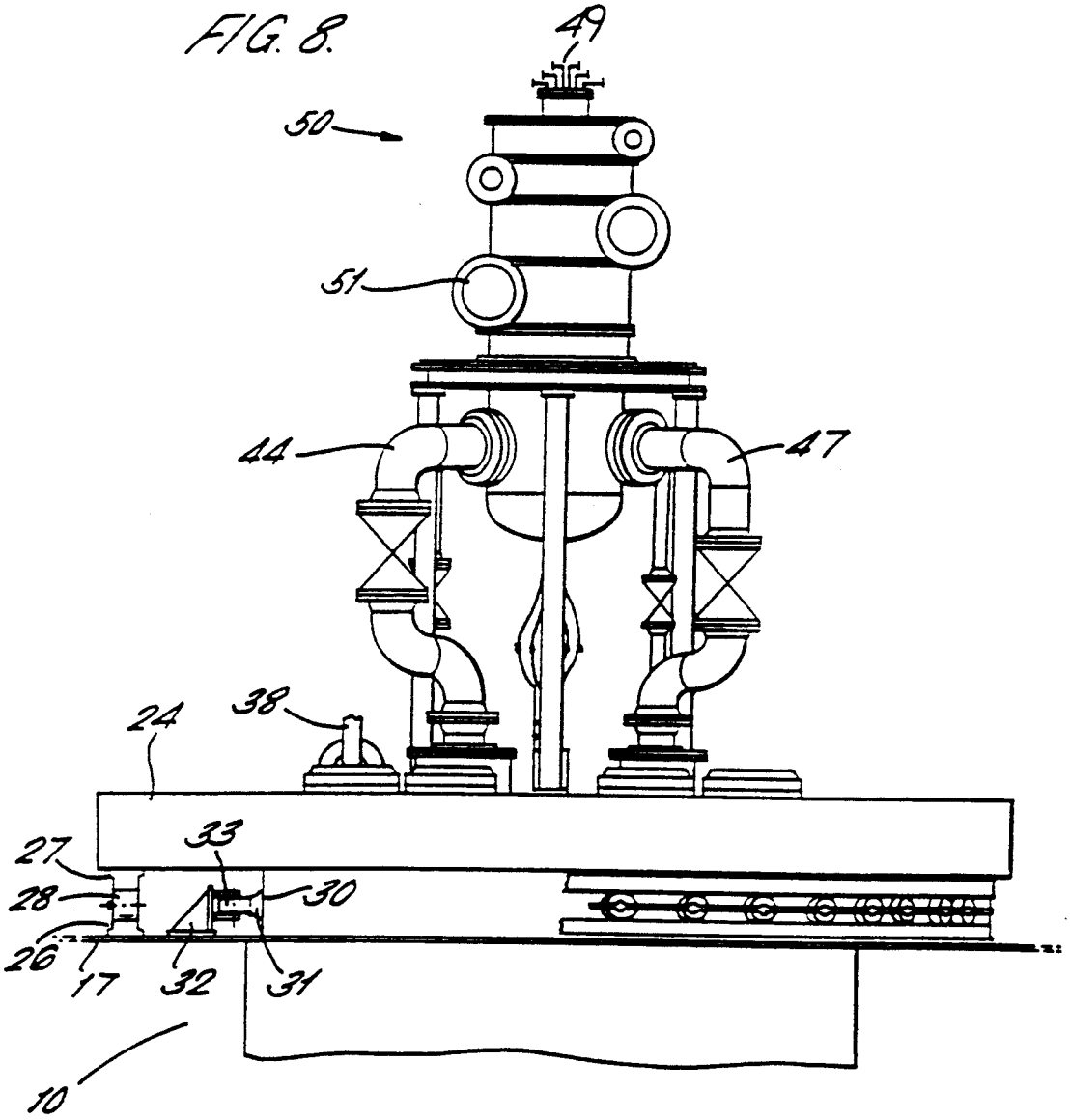
FIG. 8 is an elevation view of a multiple rotary coupling unit for connecting the manifolds to conduits in the vessel.

A multiple rotary coupling 50 is mounted on the upper table 24 as shown in FIG. 8 comprising a stack of rotary coupling units each comprising inner and outer annular members with an annular passage formed between them. The conduits 44 and 47 extending from the annular manifolds 41 and 45 disposed between the vessel hulls are connected along with any other similar pipelines to respective inner annular members of respective couplings to remain stationary with the turret and the outer members of the couplings have conduit connections indicated at 51 to supply gas/oil received from the well to processing/storage tanks on the vessel or to receive gas/water for injection to the well from corresponding supplies on the vessel.

Thus the arrangement eliminates the need for a seabed manifold and the maintenance/servicing involved therein. The multiple rotary connector is simplified in that only a single connector is required for an oil or gas supply from the collection manifold disposed between the upper and lower hulls. Not only is the cost of the rotary connector reduced but also the load imposed on the upper hull of the vessel is reduced by reason of the use of a reduced part connector. Instead of taking the mooring chains to the upper table of the turret, they could be stopped at the lower table between the hulls or to chain stoppers mounted on a part of the turret projecting below the lower hull. Other forms of bearings could also be used for supporting the turret in the upper and lower hulls.

I claim:

1. A floating oil/gas production terminal comprising a multi-hull vessel having a plurality of vertically spaced barge form hulls interconnected together to form a unitary structure including an upper hull which floats the vessel and a lower hull which provided gas-/oil/other liquid storage space, a vertical throughway extending through the hulls towards one end thereof, manifold means disposed in a free space between the hulls and mounted for rotation on at least one of the upper and lower hulls about a vertical axis extending through the throughway to receive a plurality of pipelines connected to seabed wellheads, and a rotary fluid coupling having two elements relatively rotatable about said vertical axis, one element having means for connection to conduit means mounted on the upper hull and a second element connected by conduit to the manifold means between the hulls whereby the vessel may swing about said vertical axis leaving said manifold means and the pipelines connected thereto stationary with respect to the seabed.

2. A vessel as claimed in claim 1, wherein the manifold means comprise an annular manifold mounted with its axis coincident with the throughway axis to rotate with the hulls about said vertical axis, the manifold having a plurality of connections to receive fluid pipelines from a wellhead or wellheads and having a conduit connection to said rotary fluid coupling.

3. A vessel as claimed in claim 1, wherein said manifold means comprise a plurality of annular manifolds mounted for rotation about the vertical axis on at least one of the upper and lower hulls for connection to separate sets of pipelines, and a corresponding plurality of said rotary fluid couplings are provided to which the manifolds are respectively connected.

4. A vessel as claimed in claim 1, wherein a turret extends through at least part of the throughway and is mounted for rotation about said vertical axis on at least one of said hulls and said manifold means and said second element of the rotary fluid coupling are mounted on the turret.

5. A vessel as claimed in claim 4, wherein the turret is mounted on the upper hull of the vessel and extends downwardly through the upper hull and the manifold means is suspended from the turret between the hulls of the vessel.

6. A vessel as claimed in claim 4, wherein the turret is mounted on the lower hull and projects upwardly therefrom through the upper hull to support said second element of the rotary fluid coupling mounted above the upper hull.

7. A vessel as claimed in claim 6, wherein the turret has a turntable overlying the lower hull around the throughway therein and bearing means are provided between the turntable and deck of the lower hull to support the turret vertically and further bearing means are provided between the turret and the throughway in the lower hull to support the turret horizontally.

8. A vessel as claimed in claim 4, wherein the turret extends through both upper and lower hulls and is mounted on both hulls carrying said second element of the rotary fluid coupling above the upper hull and the manifold means between the hulls.

9. A vessel as claimed in claim 4, wherein the turret has an annular table at its upper end extending over the upper hull around the upper end of the throughway therein and supported on the upper hull on bearing means to support the turret in the vertical direction and further bearing means being provided between the turret and throughway to support the turret horizontally.

10. A vessel as claimed in claim 9 wherein the turret is supported in both upper and lower hulls and further bearing means are provided between the turret and the throughway in the upper and lower hulls to assist in supporting the turret horizontally.

11. A vessel as claimed in claim 4, wherein anchor means for anchoring the vessel to the seabed are also connected to said turret whereby the vessel may swing about said vertical axis with the manifold means and pipelines connected thereto remaining stationary with respect to the seabed.

12. A vessel as claimed in claim 11, wherein the anchorage means comprise chain stopper means mounted on the turret to receive at least one anchor chain from the seabed.

13. A vessel as claimed in claim 11 wherein the lower end of the turret extends through the lower hull of the vessel and hawser pipes are mounted in the lower end of the turret to receive chains from the seabed and said chain stopper means are provided on the turntable of the turret to receive the ends of the anchor chains.

* * * * *

UNITED STATES PATENT AND TRADEMARK OFFICE

CERTIFICATE OF CORRECTION

PATENT NO. : 5,279,240

DATED : January 18, 1994

INVENTOR(S) : MARVIN S. WORLEY

It is certified that error appears in the above-identified patent and that said Letters Patent is hereby corrected as shown below:

Col. 6, line 65, delete "claim 11", insert --claim 12--

Signed and Sealed this

Twenty-fourth Day of May, 1994

*Attest:*

Bruce Lehman

BRUCE LEHMAN

*Attesting Officer*

*Commissioner of Patents and Trademarks*